US005503284A

United States Patent [19]

Li

[11] Patent Number: 5,503,284

[45] Date of Patent: Apr. 2, 1996

[54] SINGLE CONTINUOUS WALL, MULTI-CHAMBER CONTAINER

[76] Inventor: Hofman Y. Li, 6031 N. Damen Ave., Chicago, Ill. 60659

[21] Appl. No.: 363,730

[22] Filed: Dec. 23, 1994

[51] Int. Cl.[6] ..... B65D 1/00

[52] U.S. Cl. ..... 215/383; 215/6; 220/501

[58] Field of Search ..... 215/1 C, 6, 383; 220/501

[56] References Cited

U.S. PATENT DOCUMENTS

| | | | |
|---|---|---|---|
| 236,997 | 1/1881 | Dodge . | |
| 467,727 | 1/1892 | Schon | 215/6 |
| 582,380 | 5/1897 | Tebbutt | 215/6 X |
| 836,466 | 11/1906 | Sears . | |
| 1,502,166 | 7/1924 | Weitkamp | 215/6 |
| 2,370,820 | 3/1945 | Stott . | |
| 3,321,097 | 5/1967 | Solowey | 220/501 X |
| 4,436,203 | 3/1984 | Reyner | 215/1 C X |
| 4,437,587 | 3/1984 | Duering . | |
| 4,640,895 | 2/1987 | Davis . | |
| 4,646,948 | 3/1987 | Jennings . | |
| 4,832,211 | 5/1989 | Matthews et al. . | |
| 4,856,685 | 8/1989 | Gaffney . | |
| 4,858,758 | 8/1989 | Mitchell et al. . | |
| 4,873,100 | 10/1989 | Dirksing et al. | 215/1 C X |
| 4,877,142 | 10/1989 | Doering . | |
| 5,123,575 | 6/1992 | Li . | |
| 5,310,068 | 5/1994 | Saghri | 215/1 C X |

FOREIGN PATENT DOCUMENTS

| | | |
|---|---|---|
| 162516 | 2/1904 | Germany . |
| 2540090 | 8/1975 | Germany . |
| 407854 | 3/1934 | United Kingdom . |

*Primary Examiner*—Steven M. Pollard

*Attorney, Agent, or Firm*—Dressler, Goldsmith, Shore & Milnamow, Ltd.

[57] ABSTRACT

A container for storing and pouring liquids includes a single continuous wall forming a top, a bottom and sides thereof. The container has lower, intermediate and upper chambers, each chamber separated from the other by partitions formed as part of the continuous container wall. The partitions and the opposing walls of the container define orifices therebetween. The partitions prevent the lower chamber from being emptied of the liquid when the container is rotated to a horizontal position.

10 Claims, 9 Drawing Sheets

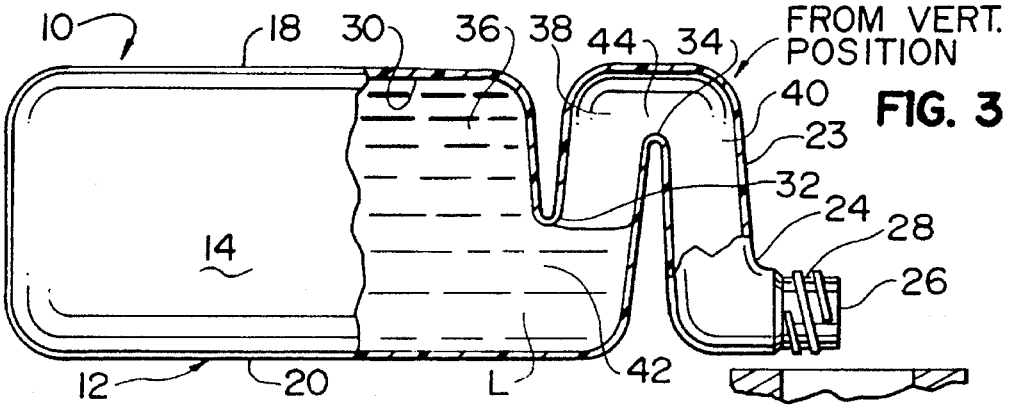
FIG. 3
FIG. 4
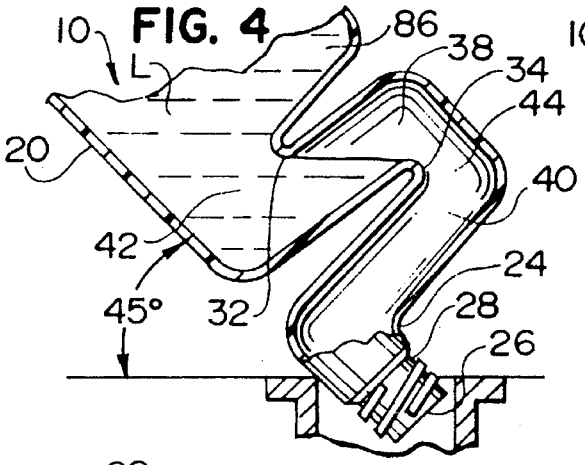
FIG. 5
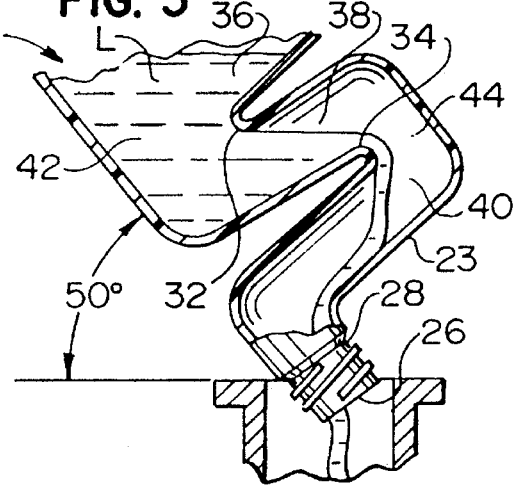
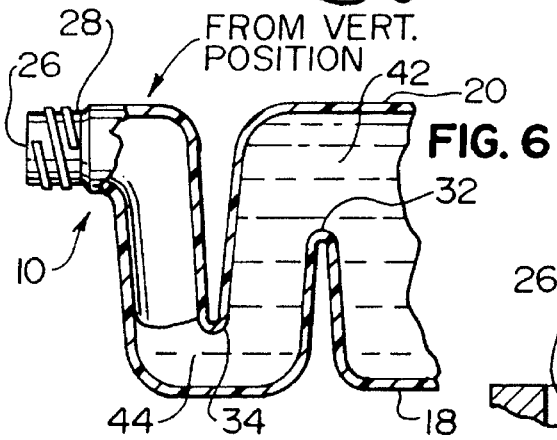
FIG. 6
FIG. 7
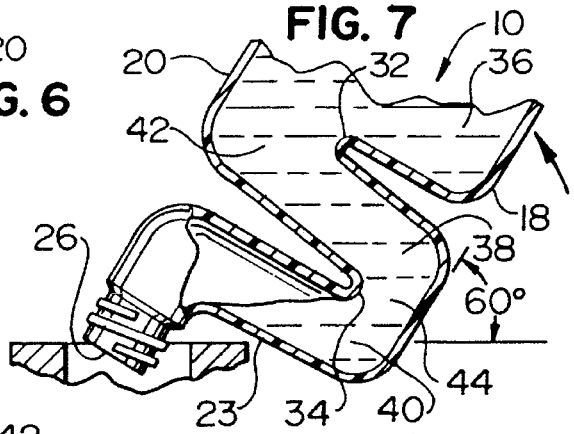
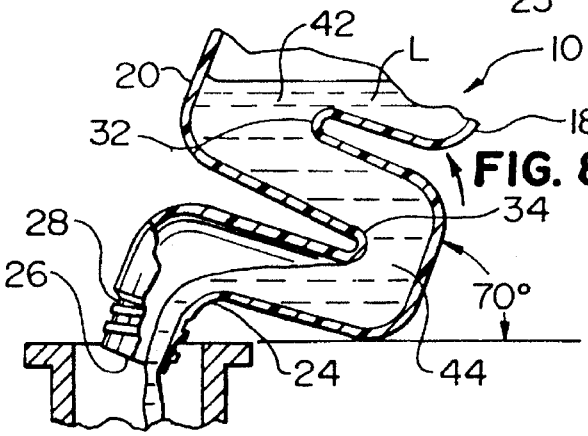
FIG. 8

SINGLE CONTINUOUS WALL, MULTI-CHAMBER CONTAINER

TECHNICAL FIELD OF THE INVENTION

This invention pertains to a container for storing and pouring liquids, and more particularly to a single continuous wall, multi-chamber container for storing and pouring liquids, which prevents an interior chamber of the container from emptying until the container is rotated sufficiently.

BACKGROUND OF THE INVENTION

Fluids, such a motor oil and the like are often stored in containers which do not effectively permit pouring the contents from the container without spilling. As is commonly recognized, it is difficult, at best, to pour motor oil from a container into an engine, without spilling some of the oil before the container spout can be positioned in the engine. Although a funnel placed into the engine crank case opening can alleviate this problem, often a funnel is not easily or conveniently located.

Containers are known which include baffles which prevent spillage until the container is tipped past a horizontal position. Such a container is disclosed in Gaffney, U.S. Pat. No. 4,856,685. When the container of Gaffney is rotated in one direction, it appears that the container must be further rotated about 12° to 13° past the horizontal to permit the liquid to begin to pour.

Another type of container is disclosed in Li, U.S. Pat. No. 5,123,575, which patent has the same inventor as the present application. The Li '575 patent discloses a container which has two interior, generally horizontally oriented partitions. The partitions define a large primary chamber and smaller secondary and tertiary chambers. The chambers are in fluid communication with their adjacent chamber or chambers through orifices defined in part by the partitions.

The partitions are formed of separate, stand-alone walls which are molded or formed into the container to define the chambers. The partitions prevent the primary chamber from being emptied of a liquid, until the container is inverted sufficiently to to incline, at an angle of about 8° from the horizontal.

Although the container disclosed in the Li '575 patent resolved the problems associated with pouring liquids from a container without spilling the liquids, it was recognized that the container was not readily manufactured. However, molding or assembling such a container having partitions therein proved to be costly, and not economically efficient given that generally such containers are intended for one time use.

A container of related interest is disclosed in Duering, U.S. Pat. No. 4,437,587. The container of Duering is a squeeze bottle having a single partition wall forming an overflow edge and forming a smaller chamber for carrying the liquid to be sprayed.

Thus, there continues to be a need for a container for storing and pouring liquids which has multiple chambers formed by partitions internal thereto which permit pouring without spillage, but which is formed of a single wall body.

SUMMARY OF THE INVENTION

A container for storing and pouring a liquid includes a single, continuous wall defining an interior surface and an exterior surface. The wall forms a top, a bottom, and enclosing sides of the container. the container has a first, lower chamber, a second, intermediate chamber, and a third, upper chamber.

The third chamber is adjacent to a neck terminating in an opening for pouring the liquid. The first chamber has a substantially larger volume than said second and third chambers.

The first chamber is separated from the second chamber by a first partition which is defined by flared portions of the continuous wall, and has an interior surface that is exposed to the liquid in the container if the container is filled. The exterior surface of the container is not exposed to the liquid in the container.

The first partition is oriented so as to be generally transverse to the enclosing sides and defines a first orifice between the first partition and one of the enclosing sides.

The second chamber is separated from the third chamber by a second partition which is defined by flared portions of the continuous wall. The second partition is spaced from the neck of the container.

Like the first partition, the second partition has an interior surface that is exposed to the liquid in the container if the container is filled, and an exterior surface that is not exposed to the liquid in the container.

The second partition is oriented so as to be generally transverse to the enclosing sides, and opposing the first partition. The second partition defines a second orifice between the second partition and the enclosing sides. The second orifice is in opposing relation to the first orifice.

Other features and advantages of the present invention will be apparent from the following detailed description, the accompanying drawings, and the appended claims.

BRIEF DESCRIPTION OF THE DRAWINGS

FIG. 3 is a view, partially in cross-section and partially broken away, of the container of FIG. 1, rotated to a horizontal position, showing a liquid therein;

FIG. 4 is a partial cross-sectional view, similar to FIG. 3, showing the container disposed at an angle of 45° beyond the horizontal position;

FIG. 5 is a view similar to FIG. 4, showing the container disposed at an angle of 50° beyond the horizontal;

FIG. 6 is a partial cross-sectional view of the container rotated to a horizontal position opposite that illustrated in FIG. 3;

FIG. 7 is a partial cross-sectional view similar to FIG. 6, showing the container disposed at an angle of 60° beyond the horizontal;

FIG. 8 is a view similar to FIG. 7, showing the container disposed at an angle of 70° beyond the horizontal;

DETAILED DESCRIPTION OF THE PREFERRED EMBODIMENTS

Figure 1:
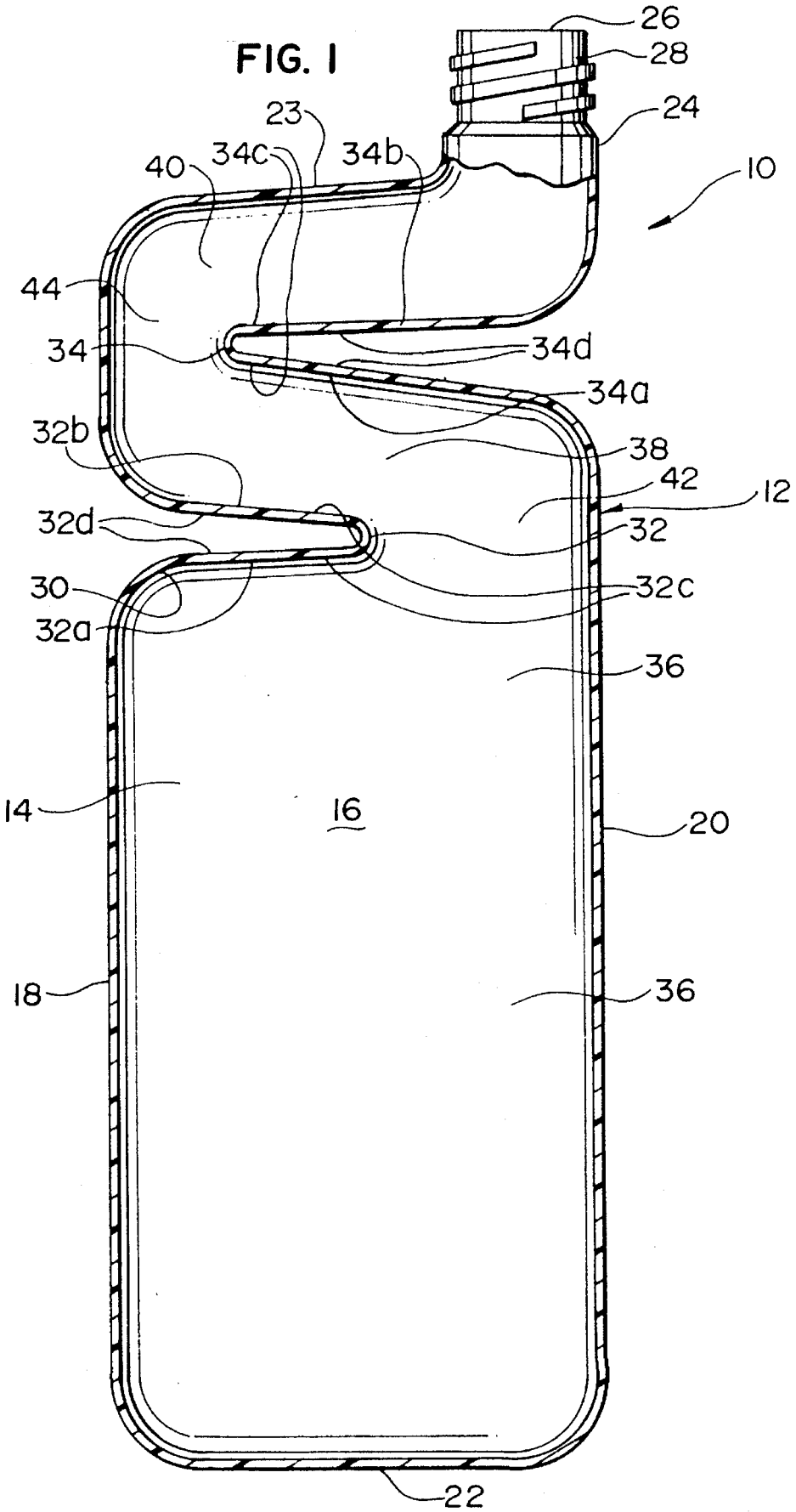
FIG. 1 is front view, partially in cross-section, of an embodiment of a container for storing and pouring liquids in accordance with the principles of the present invention.
Figure 2:
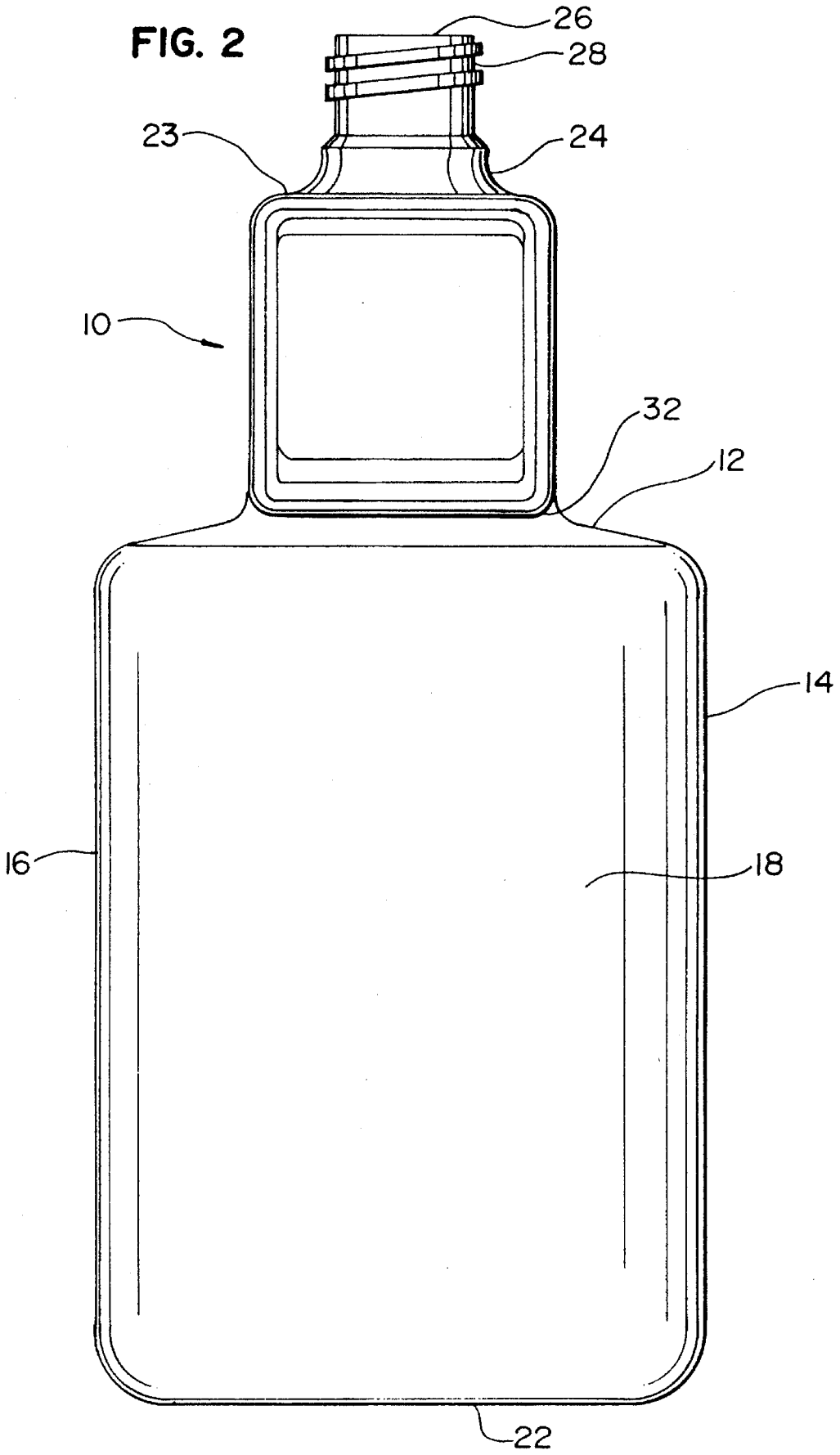
FIG. 2 is a side elevational view of the container of FIG. 1.
Figure 9:
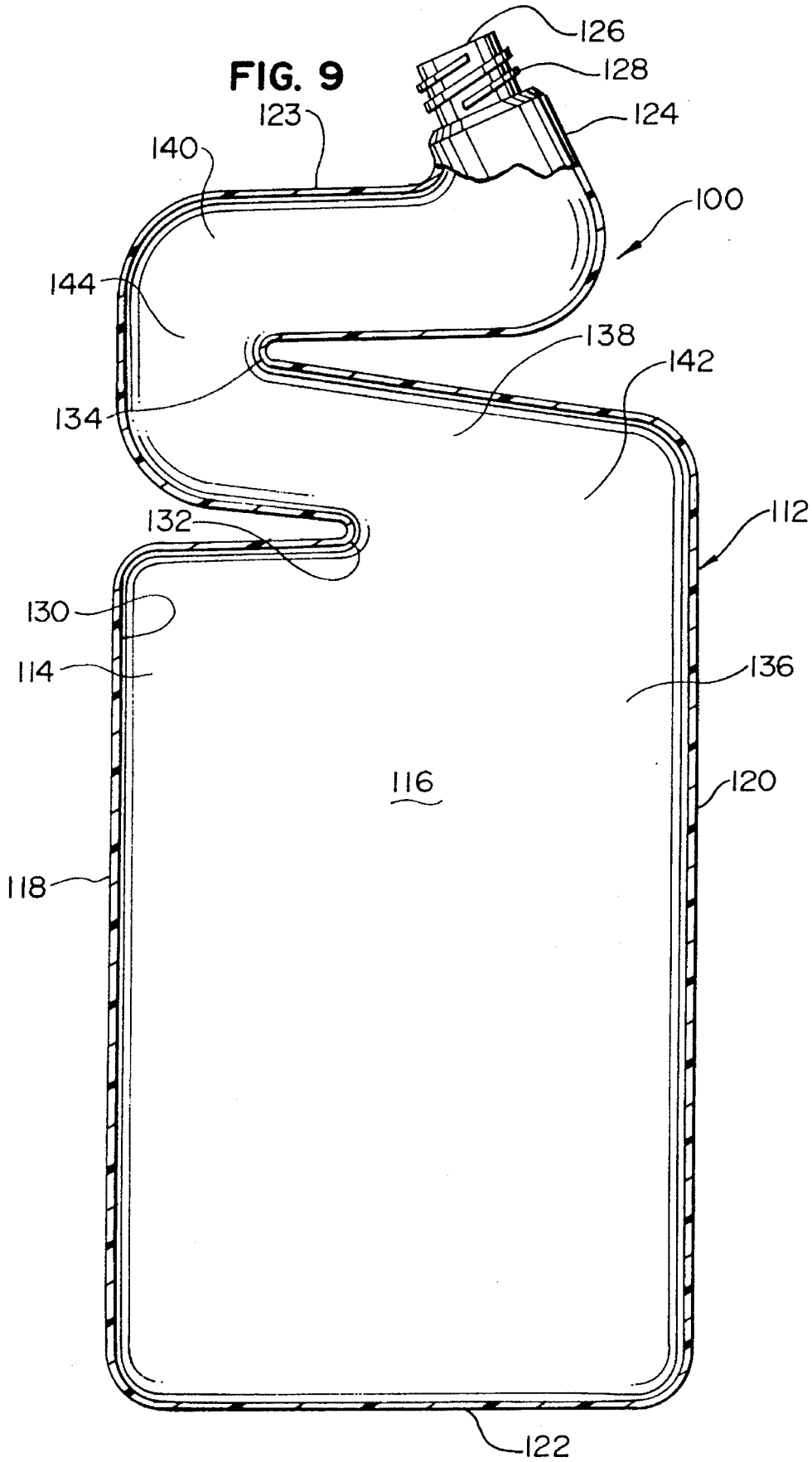
FIG. 9 is a front view, partially in cross-section, of an alternate embodiment of a container for storing and pouring liquids in accordance with the principles of the present invention.
Figure 10:
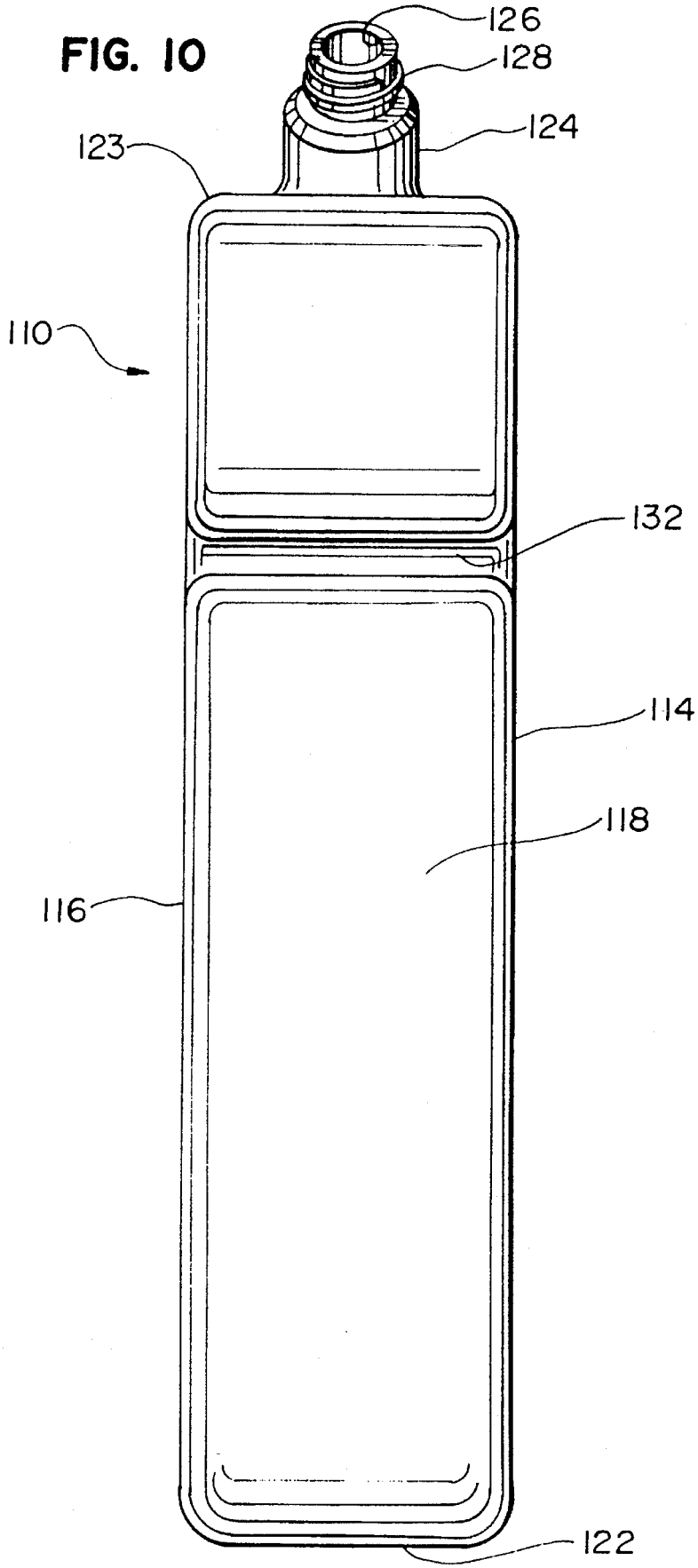
FIG. 10 is a side elevational view of the container of FIG. 9.
Figure 11:
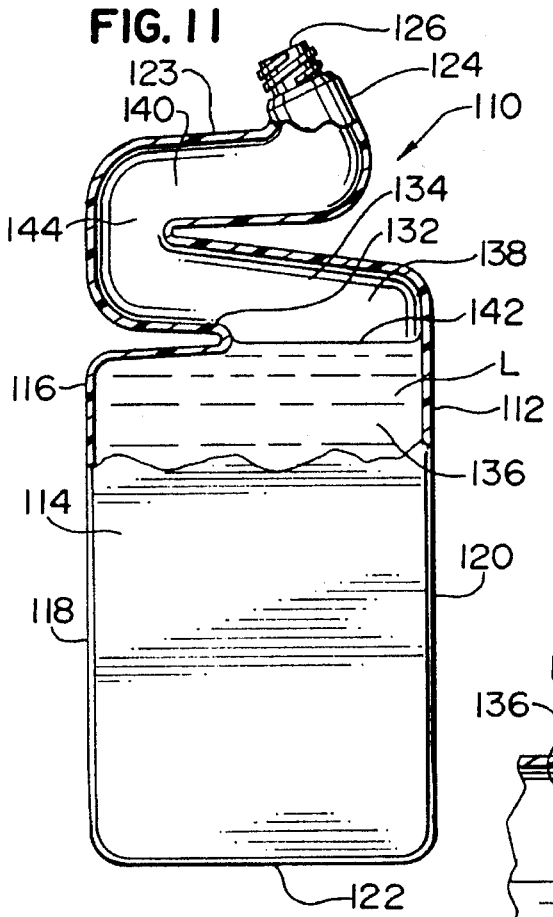
FIG. 11 is a view shown partially in cross-section and partially broken away of the container of FIG. 9 in the upright position having a liquid stored therein.

Referring now to FIGS. 1 and 2, there is shown an embodiment of the single continuous wall, multi-chamber container 10 for storing and pouring liquid L. The container 10 has a single, continuous wall 12 which forms substantially identical front and rear walls 14 and 16, respectively, side walls 18 and 20, bottom wall 22, and top 23. In this embodiment, the side walls 18 and 20 are wider than the front and rear walls 14 and 16.

The container 10 includes a neck 24 which terminates in an opening 26 for pouring the liquid L from the container 10. In a preferred embodiment, the opening 26 includes a threaded portion 28 for engaging a threaded cap (see FIGS. 16 and 17) for closing and/or sealing the container 10.

The wall 12 has a contiguous surface 30 on the interior thereof that is exposed to the liquid L if the container 10 is filled. The surface 30 defines first and second partitions 32 and 34, respectively, which are oriented so as to be generally transverse to the wall 14–20. The container includes a first, lower chamber 36, which, as seen in FIG. 1, is defined, in part, by the bottom wall 22 and the first partition 32.

A second, intermediate chamber 38 is defined, in part, by the first and second partitions 32 and 34. A third, upper chamber 40 is defined, in part, by the second partition 34 and the top 23. The third chamber 40 is spaced from the neck 24.

As best seen in FIG. 1, each of the partitions 32, 34 extend inward of the container 10, from opposing walls 18, 20, so as to be generally transverse to the enclosing sides 14–20. The partitions 32 and 34 are defined by flared portions 32*a*, 32*b* and 34*a*, 34*b* of the wall 12.

Each of the partitions 32 and 34 defines an orifice 42, 44 between the partition 32, 34 and an opposing side wall 20, 18, respectively. This configuration positions the orifices 42 and 44 in opposing relation to each other.

Each of the partitions 32 and 34 has a continuous interior surface, shown generally at 32*c* and 34*c* that is contiguous with the surface 30. Similarly, each of the partitions 32 and 34 has a continuous outer surface, shown generally at 32*d* and 34*d* that is contiguous with the outer surface of the container 10.

It is contemplated that the present embodiment of the container 10 will be used for liquids L such as motor oil and the like. As illustrated in FIGS. 3–8, the container 10 can be rotated or tipped to positions wherein the spout or opening 26 can be placed in, for example, the crank case opening of an engine (not shown) without spillage of the liquid L.

FIG. 3 illustrates the container 10 rotated from the upright or vertical position to a horizontal position wherein the opening 26 is at a low point and the orifice 44 is raised relative to the orifice 42. This permits the container 10 to be rotated with some of the liquid L flowing from the lower chamber 36 to fill only a portion of the intermediate chamber 38. As shown in FIG. 4, the container 10 can be further rotated to an angle of about 45° without the liquid L spilling from the container 10.

As illustrated in FIG. 5, when the container is further rotated to an angle of about 50° relative to the horizontal, the liquid L begins to flow from the container 10. With the container 10 positioned at this angle, the first orifice 42 is at the lowest point of the lower chamber 36 and at least part of the second orifice 44 is below the first orifice 42.

FIG. 6 illustrates the container 10 rotated from the upright position to the horizontal, in a direction opposite that shown in FIG. 3, with the opening 26 at a high point. The orifice 42 is at a higher elevation then the orifice 44.

As shown in FIG. 7, the container 10 can be rotated to an angle of about 60° relative to the horizontal without the liquid L pouring from the opening 26. When the container 10 is further rotated to an angle of about 70° relative to the horizontal, as illustrated in FIG. 8, the liquid L begins to flow from the opening 26.

In one embodiment of the container 10, the walls 14 and 16 are about two times the width of the orifice 42 and about four times the width of the orifice 44. For example, in a container 10 having walls 14 and 16 which are about three inches wide, the orifice 42 is about 1.5 inches wide and the orifice 44 is about 0.75 inches wide.

Thus, the partitions 32, 34 prevent the lower chamber 36 from being emptied until the container 10 is sufficiently inverted, e.g., rotated until the opening 26 can be positioned within, for example, the crank case opening of an engine, without the liquid L spilling therefrom.

An alternate embodiment of the container 110 is illustrated in FIGS. 9–13. This embodiment is similar to the embodiment of FIGS. 1–8, except that the side walls 118, 120 are narrower than the front and rear walls 114, 116. This configuration provides a container 110 which is well suited for uses and applications which may require squeezing the container 110 to discharge the liquid L.

Figure 13:
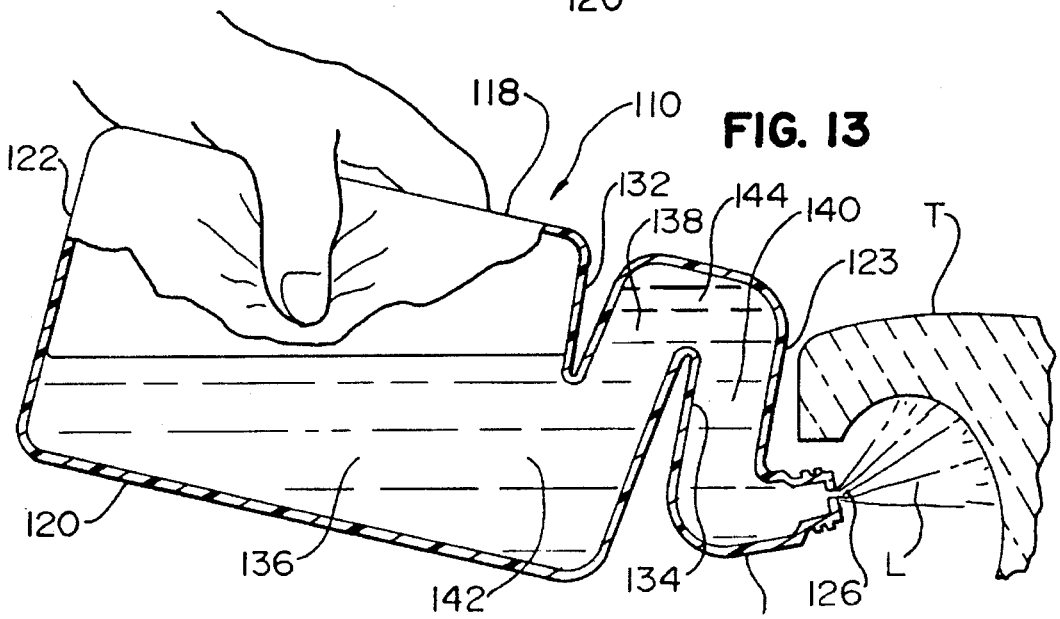
FIG. 13 is a view partially in cross-section and partially broken away. of the container of FIG. 12, disposed at an angle of about 20° from the horizontal with the liquid being discharged by squeezing the container.
Figure 14:
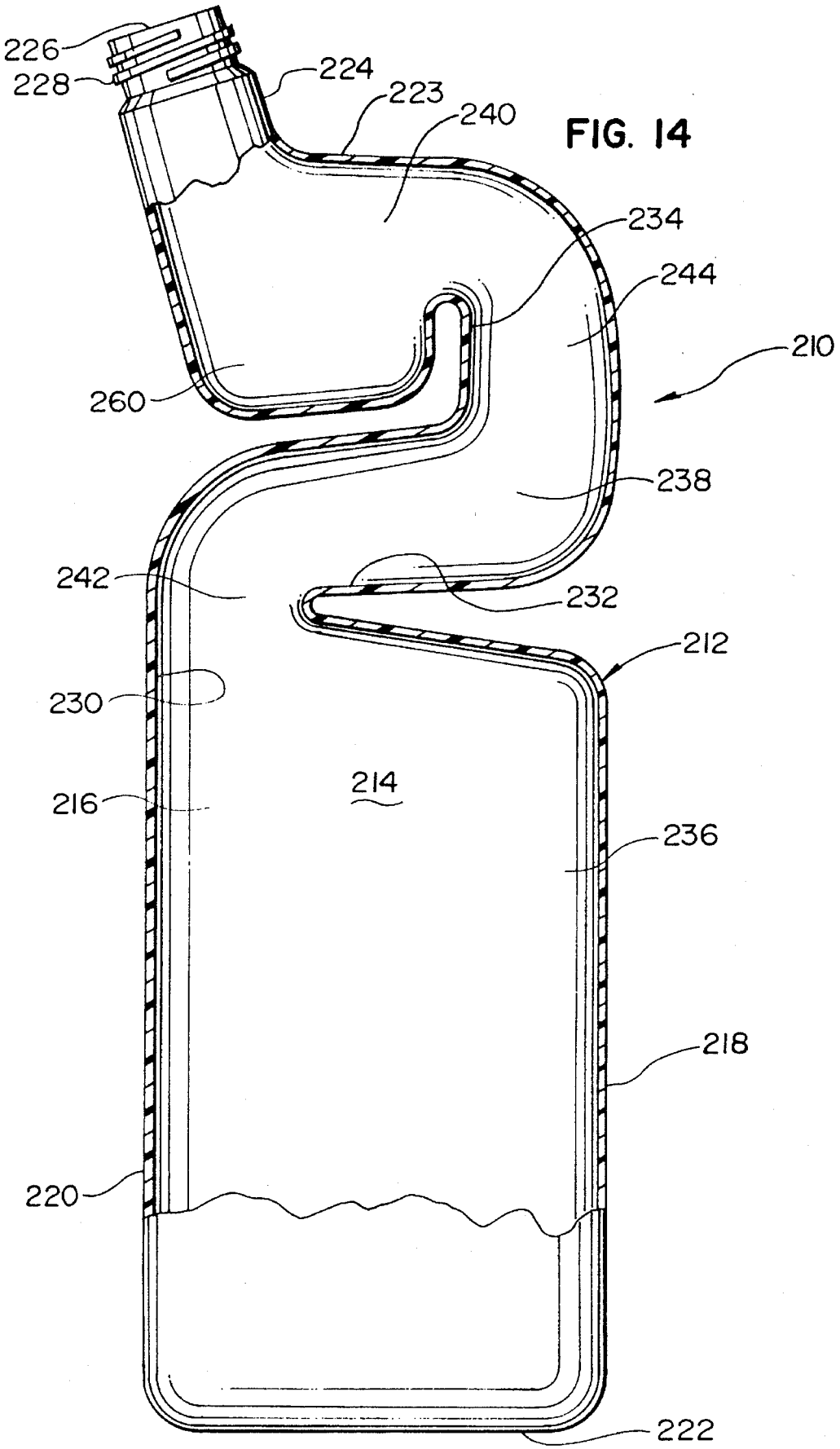
FIG. 14 is a front view, partially in cross section, of another alternate embodiment of the container.
Figure 15:
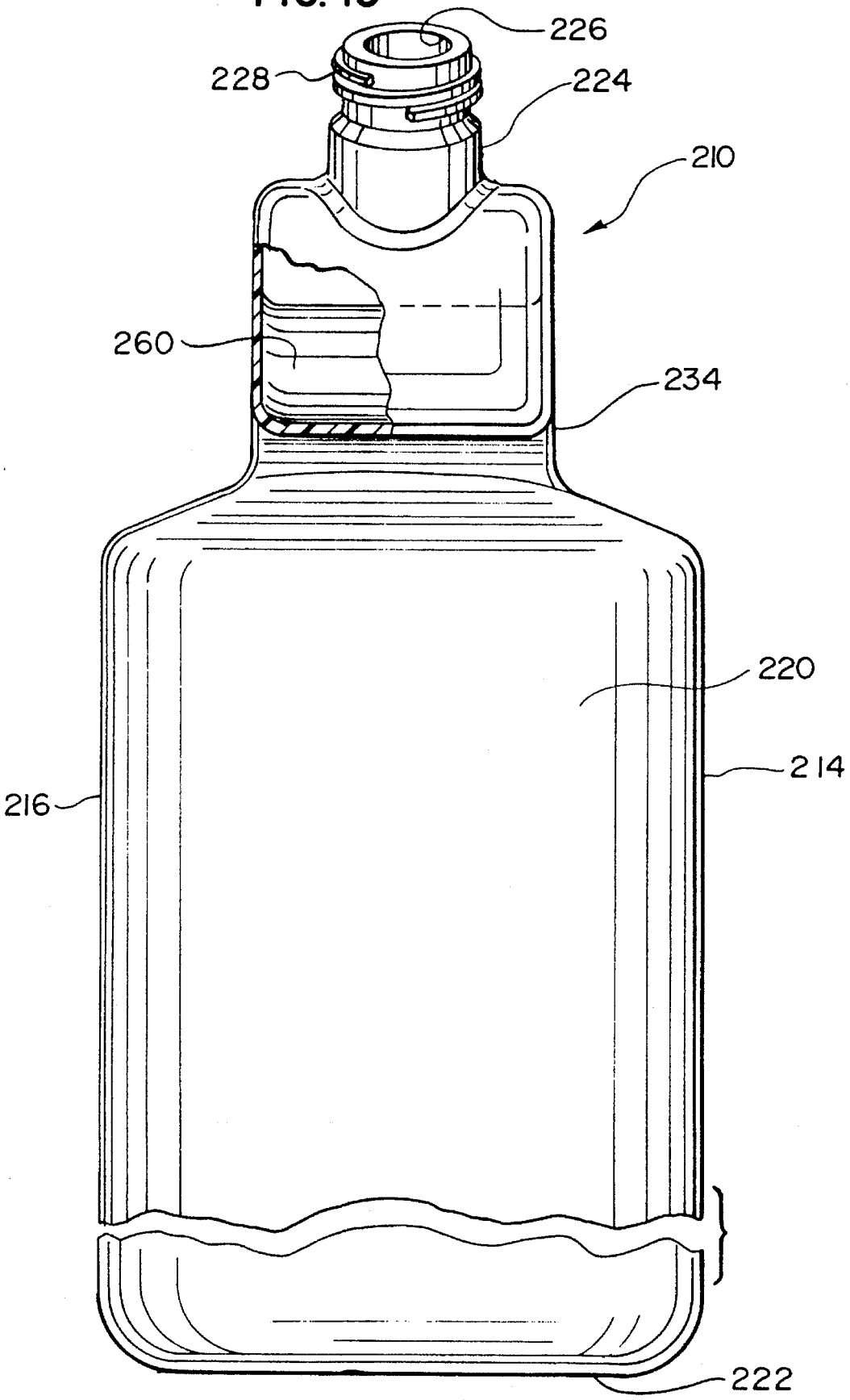
FIG. 15A is a side elevational view of the container of FIG. 14.
FIG. 15B is a similar view of another alternative embodiment.

In this embodiment, the neck area 124 is angled inwardly relative to a centerline, shown at 150, of the container 110. As shown in FIG. 13, this configuration provides a container 110 from which liquid L can be sprayed upwardly, relative to the centerline 150, for applying the liquid, for example, under the rim of a toilet T.

Similar to the embodiment illustrated in FIGS. 1–8, the container 110 includes a lower chamber, 136, and intermediate chamber 138, and an upper chamber 140. The chambers 136, 138, 140 are separated by first and second partitions 132 and 134, respectively. The partitions 132 and 134 define orifices 142 and 144, respectively, between the partitions 132 and 134 and the container walls 120, 118 opposite thereof.

Figure 12:
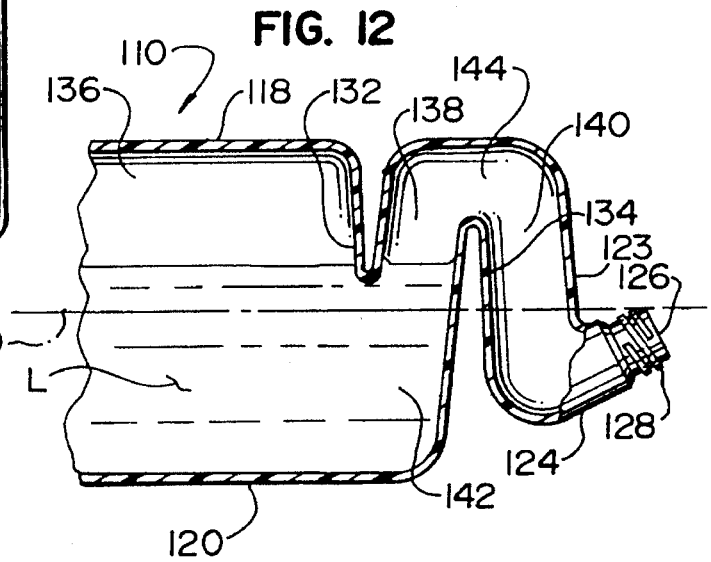
FIG. 12 is a partial cross-sectional view of the container of FIG. 11 shown in the horizontal position.

As shown in FIG. 12, the container can be disposed into the horizontal position without spillage of the liquid L therefrom. In one embodiment of such a container, the orifice 142 is about seventy percent of the width of the walls 114 and 116 and the orifice 144 is about thirty percent of the width of the walls 114 and 116.

Another embodiment of the container 210, has a measuring chamber 260 provided in the upper chamber 240, and is illustrated in FIGS. 14–20. This embodiment is similar to that shown in FIGS. 1–8, except for the inclusion of the measuring chamber 260, and a neck area 224 which is angled outwardly of the centerline, shown at 250.

As in the previously described embodiments, the container 210 includes a lower chamber, 236, and intermediate chamber 238, and an upper chamber 240. The chambers 236, 238, 240 are separated by first and second partitions 232 and 234, respectively. The partitions 232 and 234 define orifices 242 and 244 respectively between the partitions 232 and 234 and the container walls 220, 218 opposite thereof.

Figure 16:
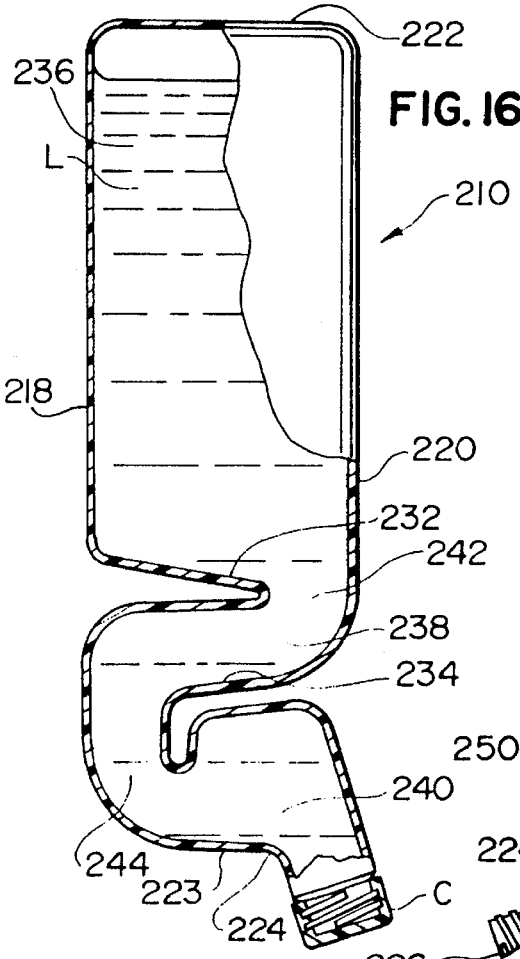
FIG. 16 is a partial cross-sectional view of the container of FIG. 14, rotated to a fully inverted position.
Figure 17:
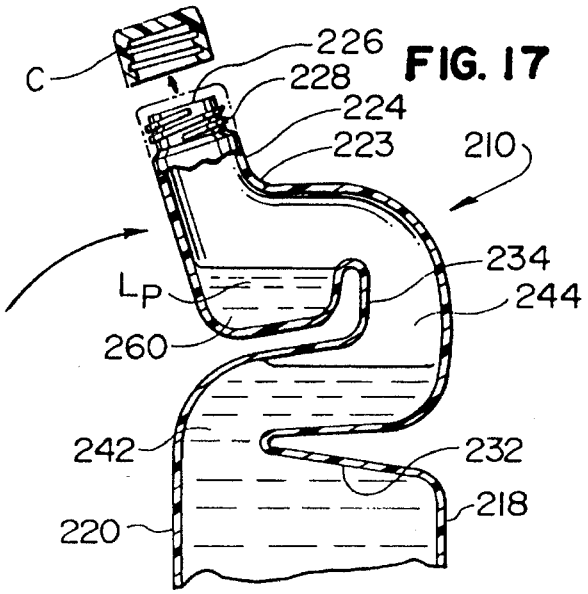
FIG. 17 is a partial cross-sectional view of the container of FIG. 16 rotated to the upright position, with the upper chamber full.
Figure 18:
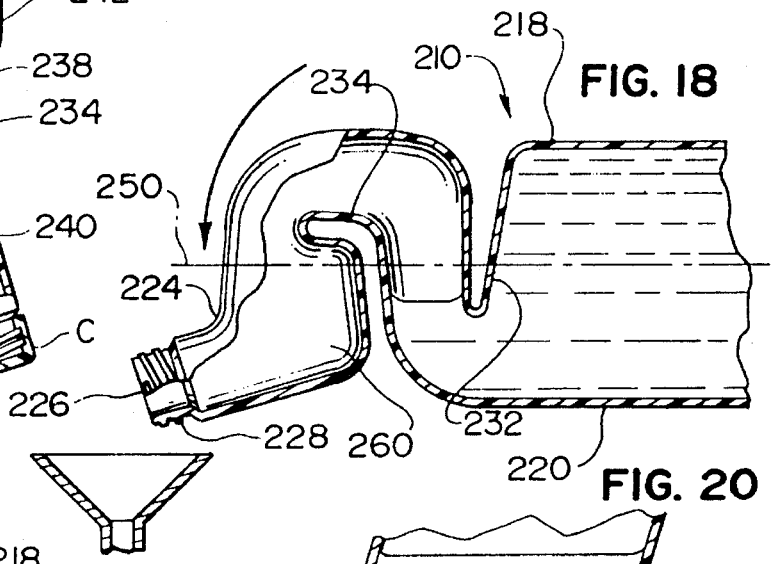
FIG. 18 is a partial cross-sectional view of the container of FIG. 17 rotated to the horizontal position for discharging the upper chamber.

This embodiment of the container 210 can be used, as illustrated in FIGS. 16–18 to dispense a predetermined amount of liquid L, without all of the liquid L from the lower chamber 236 pouring out. With the cap C in place, the container 210 is inverted sufficiently for the liquid L to flow to upper chamber 240. When the container 210 is rotated back to the upright position, as shown in FIG. 17, a predetermined amount of the liquid $L_p$ remains in the measuring chamber 260.

Figure 19:
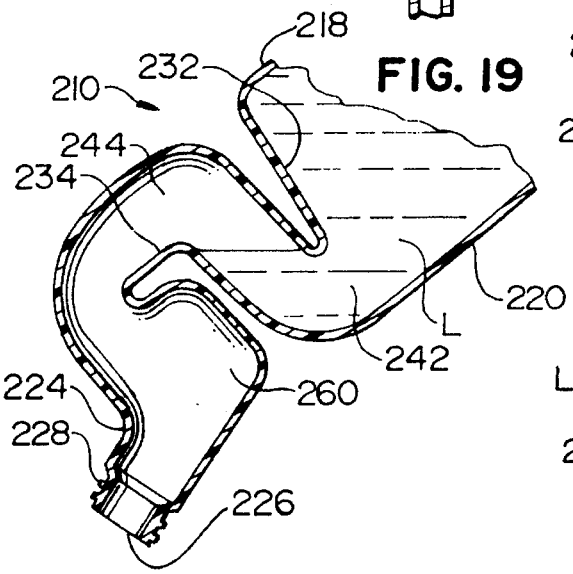
FIG. 19 is a partial cross-sectional view of the container of FIG. 14 disposed at an angle of about 40° from the horizontal.
Figure 20:
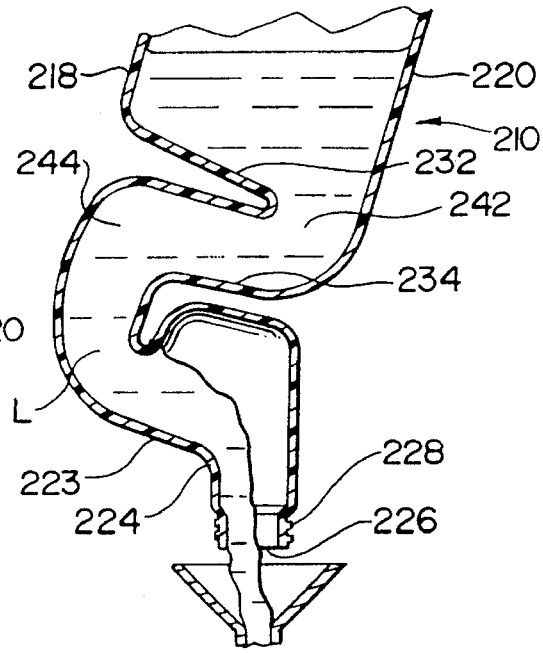
FIG. 20 is a partial cross-sectional view of the container of FIG. 20 rotated from the position of FIG. 19 to a discharge or emptying position.

The measured amount of liquid $L_p$ in the measuring chamber 260 can be dispensed (without pouring out the liquid L in the lower chamber 236) by rotating the container 210, as illustrated in FIG. 18, to about the horizontal position. Similar to the embodiment shown in FIGS. 1–8 the container 210 can be further inverted, as shown in FIGS. 19–20, to pour the liquid L therefrom.

In one embodiment of the container 210, the walls 214 and 216 are about three times the width of the orifices 242 and 244. For example, in a container 210 having wall 214 and 216 which are about three inches wide, the orifices 242 and 244 are each about 1 inch wide.

The container 10, 110, 210 is formed of a flexible plastic material or the like. It is contemplated that the container 10, 110, 210 is formed from a blow molding or similar process. Other materials and processes or methods of manufacture are within the scope of the present invention.

Thus, there has been described a container which includes partitions formed of the container walls, which container can be rotated from the upright position without spillage of the liquid therefrom, until the container has been rotated past the horizontal position.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A container for storing and pouring a liquid, the container comprising a single, continuous, outer wall defining an interior surface of the container and an exterior surface of the container, said wall forming a top, a bottom, and enclosing sides and forming a first, lower chamber, a second, intermediate chamber, and a third, upper chamber, said third chamber being adjacent to a neck formed by said wall, extending from the top, and terminating in an opening for pouring the liquid, said first chamber having a substantially larger volume than said second and third chambers, wherein said first chamber is separated from said second chamber by a first partition defined by flared portions of said continuous wall, said first partition having an interior surface that is a part of the interior surface of the container and that is exposed to the liquid in the container if the container is filled, said first partition having an exterior surface that is a part of the exterior surface of the container and that is not exposed to the liquid in the container, said first partition being oriented so as to be generally transverse to said enclosing sides and defining a first orifice between said first partition and one of said enclosing sides, wherein said second chamber is separated from said third chamber by a second partition defined by flared portions of said continuous wall and spaced from said neck, said first partition having an interior surface that is a part of the interior surface of the container and that is exposed to the liquid in the container if the container is filled, said first partition having an exterior surface that is a part of the exterior surface of the container and that is not exposed to the liquid in the container, said first partition being oriented so as to be generally transverse to said enclosing sides and defining a second orifice between said second partition and one of said enclosing sides, said second orifice being in opposing relation to said first orifice, and said second partition being longer than said first partition.

2. The container of claim 1 wherein said partitions constitute means for preventing the first chamber from being emptied of the liquid when the container is rotated from an upright position in a rotational direction tending to raise said second orifice relative to said first orifice and lower said first orifice relative to said second orifice upon initial rotation of said container, unless said container is inverted sufficiently upon further rotation of said container in the same rotational direction to dispose said first orifice at the lowest point of the first chamber and to dispose at least part of said second orifice below at least part of said first orifice.

3. The container of claim 2, which is blow molded to comprise the single, continuous, outer wall.

4. The container of claim 1 wherein the container has substantially identical front and rear walls having a predetermined width and wherein said first orifice has a width of about one-half of the width of said front and rear walls, and wherein said second orifice has a width of about one-fourth of the width of said front and rear walls.

5. The container of claim 1 wherein the container has substantially identical front and rear walls having a predetermined width and wherein said first orifice has a width of about seven-tenths of the width of said front and rear walls, and wherein said second orifice has a width of about three-tenths of the width of said front and rear walls.

6. The container of claim 5 wherein said neck is angled inwardly toward a centerline of said container.

7. The container of claim 5 wherein said neck is angled outwardly away from a centerline of said container.

8. The container of claim 1 wherein the container has substantially identical front and rear walls having a predetermined width and wherein said first orifice has a width of about one-half of the width of said front and rear walls, and wherein said second orifice has a width of about one-third of the width of said front and rear walls.

9. The container of claim 8 wherein said upper chamber includes a measuring chamber.

10. The container of claim 1, which is blow molded to comprise the single, continuous, outer wall.

* * * * *